US008648885B2

(12) United States Patent
Lee et al.

(10) Patent No.: US 8,648,885 B2
(45) Date of Patent: Feb. 11, 2014

(54) METHOD FOR CREATING GAMMA LOOK-UP TABLE AND DISPLAY DEVICE

(75) Inventors: Yu-Chung Lee, Tao Yuan County (TW); Cheng-Chuan Tsai, Hsin Chu (TW); Pei-Chen Huang, Tainan County (TW)

(73) Assignee: Realtek Semiconductor Corp., Hsinchu (TW)

( * ) Notice: Subject to any disclaimer, the term of this patent is extended or adjusted under 35 U.S.C. 154(b) by 877 days.

(21) Appl. No.: 12/704,028

(22) Filed: Feb. 11, 2010

(65) Prior Publication Data

US 2010/0225663 A1 Sep. 9, 2010

(30) Foreign Application Priority Data

Mar. 6, 2009 (TW) ..... 98107233 A

(51) Int. Cl.
*G09G 5/10* (2006.01)

(52) U.S. Cl.
USPC ..... 345/690

(58) Field of Classification Search
None
See application file for complete search history.

(56) References Cited

U.S. PATENT DOCUMENTS

2004/0196303 A1* 10/2004 Matsuda ..... 345/690
2006/0267923 A1* 11/2006 Kerofsky ..... 345/102
2008/0079746 A1* 4/2008 Ou-Yang et al. ..... 345/589
2008/0225055 A1 9/2008 Yu et al.
2009/0087091 A1* 4/2009 Hatori ..... 382/167
2009/0231256 A1* 9/2009 Kim ..... 345/89

OTHER PUBLICATIONS

Yukio Okano and Nozomu Shiotani, Color Reproduction Chracteristics of Liquid Crystal Display Panels and New Compensation Methods for Them; Sharp Technical Reports, Aug. 2001.*

* cited by examiner

*Primary Examiner* — Carlos Perromat
(74) *Attorney, Agent, or Firm* — McClure, Qualey & Rodack, LLP

(57) ABSTRACT

A method for creating a Gamma look-up table (LUT) includes: calculating interpolated display characteristics of a plurality of colors by using a nonlinear interpolation algorithm based on a plurality of display characteristics of the predetermined patterns wherein the number of the display characteristics is smaller than the product of the number of the colors and the number of the interpolated display characteristics of the colors; and correcting the interpolated display characteristics of the colors on the basis of a maximum display characteristic value and a reference gamma value so that the Gamma look-up table is created. The predetermined patterns comprise a plurality of gray level patterns which one-by-one correspond to a plurality of levels, and the interval of a pair of adjacent gray level patterns among the gray level patterns is different from the interval of another pair of adjacent gray level patterns among the gray level patterns.

23 Claims, 5 Drawing Sheets

METHOD FOR CREATING GAMMA LOOK-UP TABLE AND DISPLAY DEVICE

BACKGROUND OF THE INVENTION (a) Field of the Invention

The invention relates to a method for creating a Gamma look-up table and a display device using the same, particularly to a method for creating a Gamma look-up table by using a nonlinear interpolation algorithm and a display device using the same.

(b) Description of the Related Art

In order to further improve image quality of a display device, an image signal to be inputted into a display device should be processed by Gamma correction/calibration. FIG. 1 shows a schematic diagram illustrating a display device having a Gamma correction function in the prior art. A conventional display device 10 comprises a memory 12, a scaler 13, and a display panel 14, as shown in FIG. 1. The memory 12 can be an electrically erasable programmable read-only memory (EEPROM) and stores a Gamma look-up table (LUT). The scaler 13 receives an image signal S1, accesses the Gamma look-up table from the memory 12, and then corrects the image signal S1 according to the Gamma look-up table so as to generate a corrected image signal S2 for the display panel 14 to display the image corresponding to the image signal S1.

During the mass production of display devices, the mass-produced display panel 14 uses the same Gamma look-up table. But, the display panel 14 is inevitably different from each other due to process variation so that the Gamma correction is inappropriate for some display devices. As the Gamma correction is so severely bad, sometimes gray-scale/color shift may result.

BRIEF SUMMARY OF THE INVENTION

One object of the invention is to provide a method for creating a Gamma look-up table in order to solve the above-mentioned problems in the prior art.

One embodiment of the invention provides a method for creating a gamma look-up table. The method comprises: receiving display characteristics of a plurality of predetermined patterns; calculating interpolated display characteristics of a plurality of colors by using a nonlinear interpolation algorithm based on the display characteristics of a plurality of predetermined patterns wherein the number of the display characteristics of the predetermined patterns is smaller than the product of the number of the colors and the number of the interpolated display characteristics of the colors; and correcting the interpolated display characteristics of the colors on the basis of a maximum display characteristic value and a reference gamma value so that the Gamma look-up table is created. Besides, the predetermined patterns comprise a plurality of gray level patterns which one-by-one correspond to a plurality of levels, and the interval of a pair of adjacent gray level patterns among the gray level patterns is different from the interval of another pair of adjacent gray level patterns among the gray level patterns. In a preferred embodiment, the number of levels of the pair of adjacent gray level patterns among the gray level patterns is smaller than the number of levels of the another pair of adjacent gray level patterns and the interval of the pair of adjacent gray level patterns among the gray level patterns is smaller than the interval of the another pair of adjacent gray level patterns.

Another embodiment of the invention provides a display device, comprising a memory and an image processing unit.

The memory stores a Gamma look-up table (LUT) that is created by using a nonlinear interpolation algorithm based on display characteristics of a plurality of predetermined patterns. The predetermined patterns comprise a plurality of gray level patterns which one-by-one correspond to a plurality of levels, and the interval of a pair of adjacent gray level patterns among the gray level patterns is different from the interval of another pair of adjacent gray level patterns among the gray level patterns. The image processing unit receives an image signal, accesses the Gamma look-up table from the memory, and corrects the image signal based on the Gamma look-up table to generate a corrected image signal and transmit the corrected image signal to a display panel.

Another embodiment of the invention provides a display device, comprising a display panel, a memory, and an image processing unit. The memory stores display characteristics of a plurality of predetermined patterns. The display characteristics of the predetermined patterns correspond to the display panel and the predetermined patterns comprise a plurality of gray level patterns which one-by-one correspond to a plurality of levels, and the interval of a pair of adjacent gray level patterns among the gray level patterns is different from the interval of another pair of adjacent gray level patterns among the gray level patterns. The image processing unit receives an image signal, accesses the display characteristics of the predetermined patterns from the memory, and corrects the image signal based on the display characteristics of the predetermined patterns to generate a corrected image signal and output the corrected image signal to the display panel.

Other purposes and advantages of the invention can be understood by the following disclosed technical characteristics of the invention. Accompanying with the following figures, examples and claims, the above and other objectives and advantages of the invention will be described in detail in the following.

DETAILED DESCRIPTION OF THE INVENTION

The above and other technical content, characteristics, and functions of the invention will be described in details with reference to the drawings. For clarity, the wording related to direction, such as up, down, left, right, front, back, etc., used in examples is referred to the direction in drawings. Therefore, the wording related to direction is not used to limit the scope of the invention.

Figure 1:
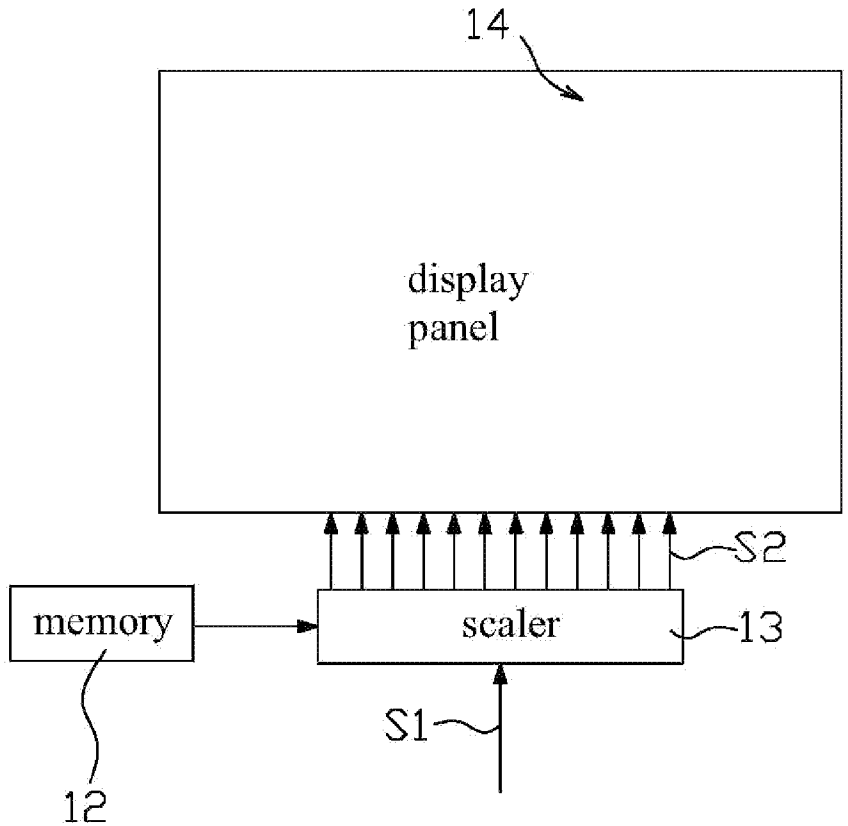
FIG. 1(PRIOR ART)
FIG. 1 shows a schematic diagram illustrating a display device having a Gamma correction function in the prior art.
Figure 2:
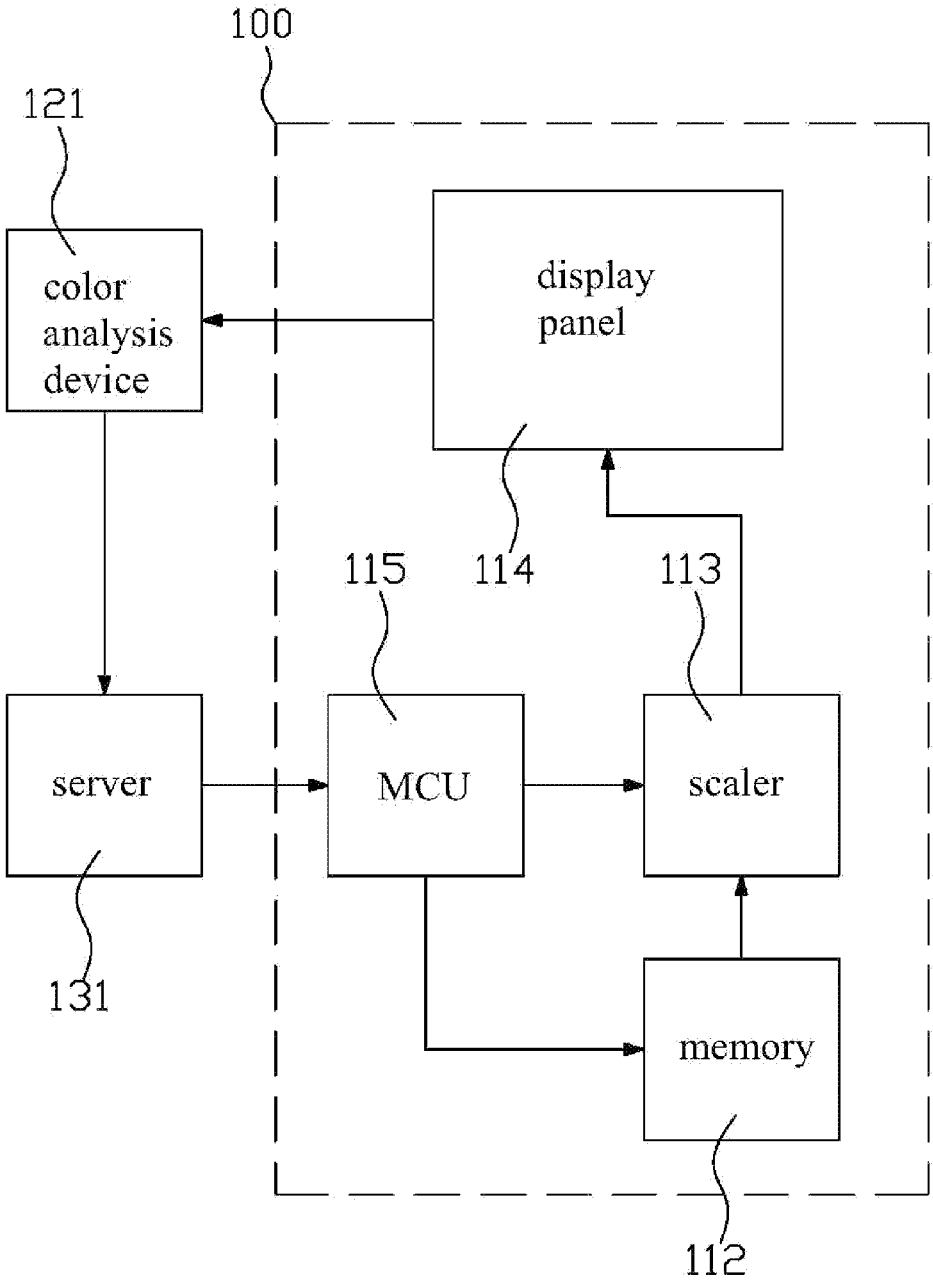
FIG. 2 shows a block diagram illustrating the structure for calculating display characteristic of a display device according to one embodiment of the invention.

FIG. 2 shows a block diagram illustrating a measurement system according to one embodiment of the invention. The measurement system comprises a color analysis device 121, a server 131, and at least one display device 100 to be measured. The measurement system is used to measure the display characteristics of the display device 100.

The display device 100 comprises a memory 12, an image processing unit Ipu, and a display panel 114. The image processing unit Ipu comprises a scaler 113 and a microprocessor (MCU) 115. Referring to FIG. 2, when the display device 100 is tested for acquisition of its display characteristics, the measurement system uses the application program in the server 131 to have the display panel 114 display different y predetermined patterns via control of the image processing unit Ipu and uses the color analysis device 121 to calculate the display characteristics of the display panel 114.

In one embodiment, the above y is an integer less than 768. The server 131 can be a computer. The color analysis device 121 can be implemented by a commercially available instrument such as Konica-Minolta CA-210 or the like. The data of the display characteristics of the y predetermined patterns of the display panel 114 can be brightness or chroma data or the combination of the above two.

In one embodiment of the invention, after the server 131 receives the data of the display characteristics of the y predetermined patterns calculated by the color analysis device 121, a Gamma look-up table is created based on the method for creating a Gamma look-up table according to the invention. The server 131 stores the Gamma look-up table created by the method according to the invention into the memory 112 of the display device 100 by means of the microprocessor 115.

Then, as the display device 100 is in operation, the image processing unit Ipu receives an image signal Si and accesses the Gamma look-up table, created based on the method according to the invention, from the memory 112. The image processing unit Ipu corrects the image signal Si based on the Gamma look-up table and creates a corrected image signal So provided to the display panel 114 so that the display panel 114 displays the image corresponding to this image signal.

As for another embodiment of the invention, after the server 131 receives the data of the display characteristics of the y predetermined patterns calculated by the color analysis device 121, the data of the display characteristics of the y predetermined patterns are stored in the memory 112 of the display device 100 via the microprocessor 115. As the display device 100 is in operation, the scaler 113 of the image processing unit Ipu accesses the data of the display characteristics of the y predetermined patterns from the memory 112. Based on the method for creating a Gamma look-up table according to one embodiment of the invention, the scaler 113 creates a Gamma look-up table, receives an image signal Si, and corrects the image signal Si based on the Gamma look-up table to generate a corrected image signal So for the display panel 114 to display the image corresponding to the image signal.

Furthermore, in another embodiment of the invention, after the server 131 receives the data of the display characteristics of the y predetermined patterns calculated by the color analysis device 121, the microprocessor 115 stores these data of the display characteristics of the y predetermined patterns in the memory 112. As the server 131 transmits a correction signal to the microprocessor 115, the scaler 113 instructed by the microprocessor 115 receives these data of the display characteristics of the y predetermined patterns from the memory 112 and creates a Gamma look-up table based on the method according to the invention. Finally, the Gamma look-up table is stored in the scaler 113. When the display device 100 is in operation, the scaler 113 of the image processing unit Ipu receives an image signal Si, directly corrects the image signal Si according to the Gamma look-up table, and creates a corrected image signal So for the display panel 114 to display the image corresponding to the image signal.

Figure 3:
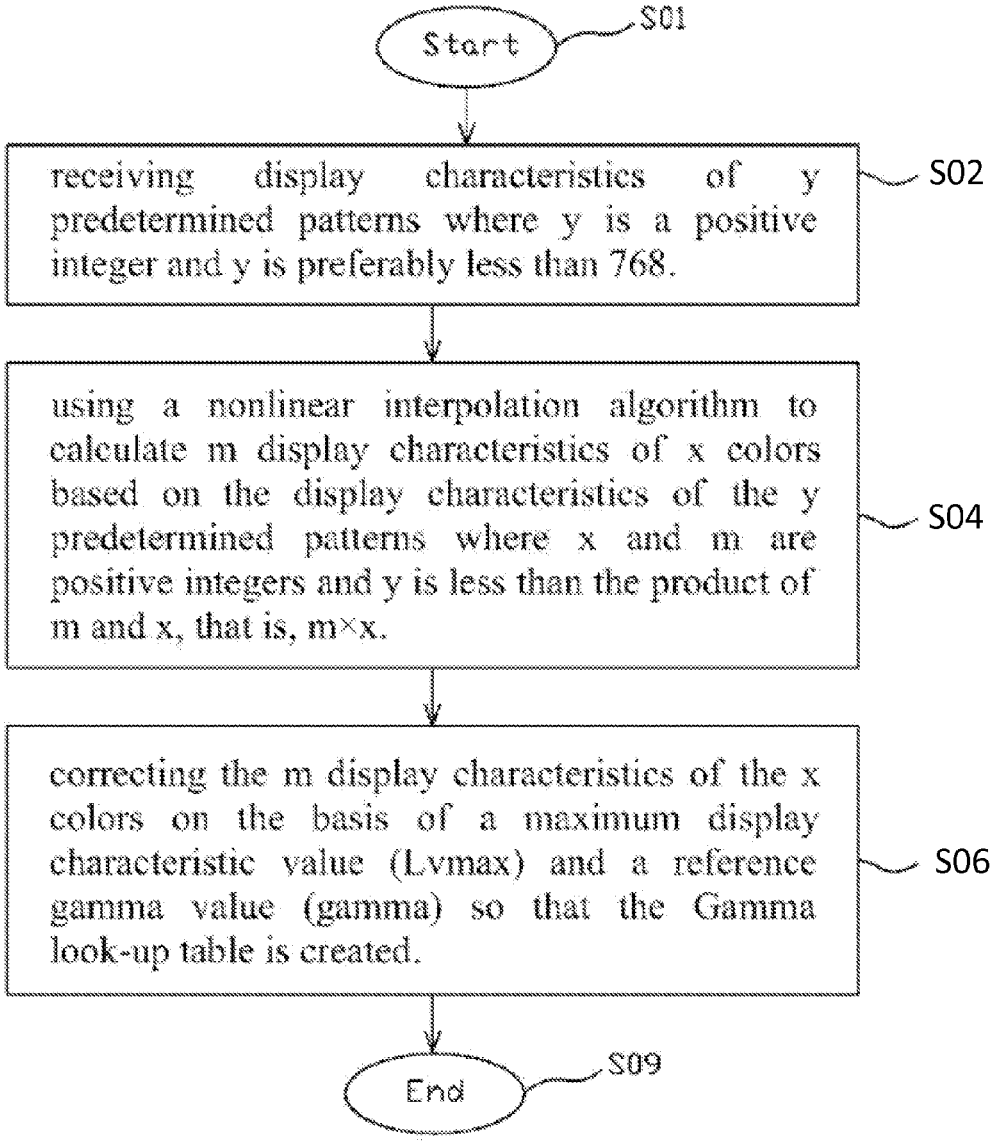
FIG. 3 shows a flow chart illustrating the method for creating a Gamma look-up table according to one embodiment of the invention.

FIG. 3 shows the method for creating a Gamma look-up table according to one embodiment of the invention, the method comprising the following steps:

Step S02: receiving display characteristics of y predetermined patterns where y is a positive integer and y is preferably less than 768;

Step S04: using a nonlinear interpolation algorithm to calculate m display characteristics of x colors based on the display characteristics of the y predetermined patterns where x and m are positive integers and y is less than the product of m and x, that is, m×x; and Step S06: correcting the m display characteristics of the x colors on the basis of a maximum display characteristic value (Lvmax) and a reference gamma value (gamma) so that the Gamma look-up table is created. In one embodiment, the m display characteristics of the x colors can be further corrected on the basis of a reference color temperature value (D) so as to create the Gamma look-up table.

In one embodiment, the brightness and chromas of the predetermined patterns can be used to create the Gamma look-up table. Besides, the display characteristics of the predetermined patterns in the Step S02 can comprise Pn levels of the brightness of gray level patterns where n=0~21. Generally, the gray level color of the display device is composed of red, green, and blue. In order to have better Gamma correction effect, the display characteristics of the predetermined patterns in this embodiment can further comprise the chromas of one full-red pattern, one full-green pattern, and one full-blue pattern.

Specifically, 22 gray level patterns where those Pns are 0, 4, 8, 16, 24, 32, 40, 48, 56, 64, 80, 96, 112, 128, 144, 160, 176, 192, 208, 224, 240, 255 levels and three patterns that are one full-red pattern, one full-green pattern, and one full-blue pattern are used as the predetermined patterns in this embodiment. That is, 25 predetermined patterns (y=25) are used. Since human eyes are more sensitive to a darker frame, the smaller interval is selected for the darker gray level pattern as the predetermined pattern while the larger interval is selected for the brighter gray level pattern. As described in the above example, the interval between two adjacent gray level patterns is separately 4, 4, 8, 8, 8, 8, 8, 8, 8, 16, 16, 16, 16, 16, 16, 16, 16, 16, 16, 16, 15. Besides, the interval may vary regularly or irregularly (randomly). Since each gray level pattern has one gray level different from each other, the gray level pattern and gray level have one-to-one corresponding relationship. Like the interval in the above 22 gray level patterns, among these gray level patterns, the interval of a pair of adjacent gray level patterns is different from the interval of another pair of adjacent gray level patterns. Among these gray level patterns in the above embodiment, the interval between two adjacent gray level patterns comprises 4, 8, 16, and 15. Preferably, among the gray level patterns, the number of levels of the pair of adjacent gray level patterns is smaller than the number of levels of the another pair of adjacent gray level patterns and the interval of the pair of adjacent gray level patterns is smaller than the interval of the another pair of adjacent gray level patterns.

Figure 4:
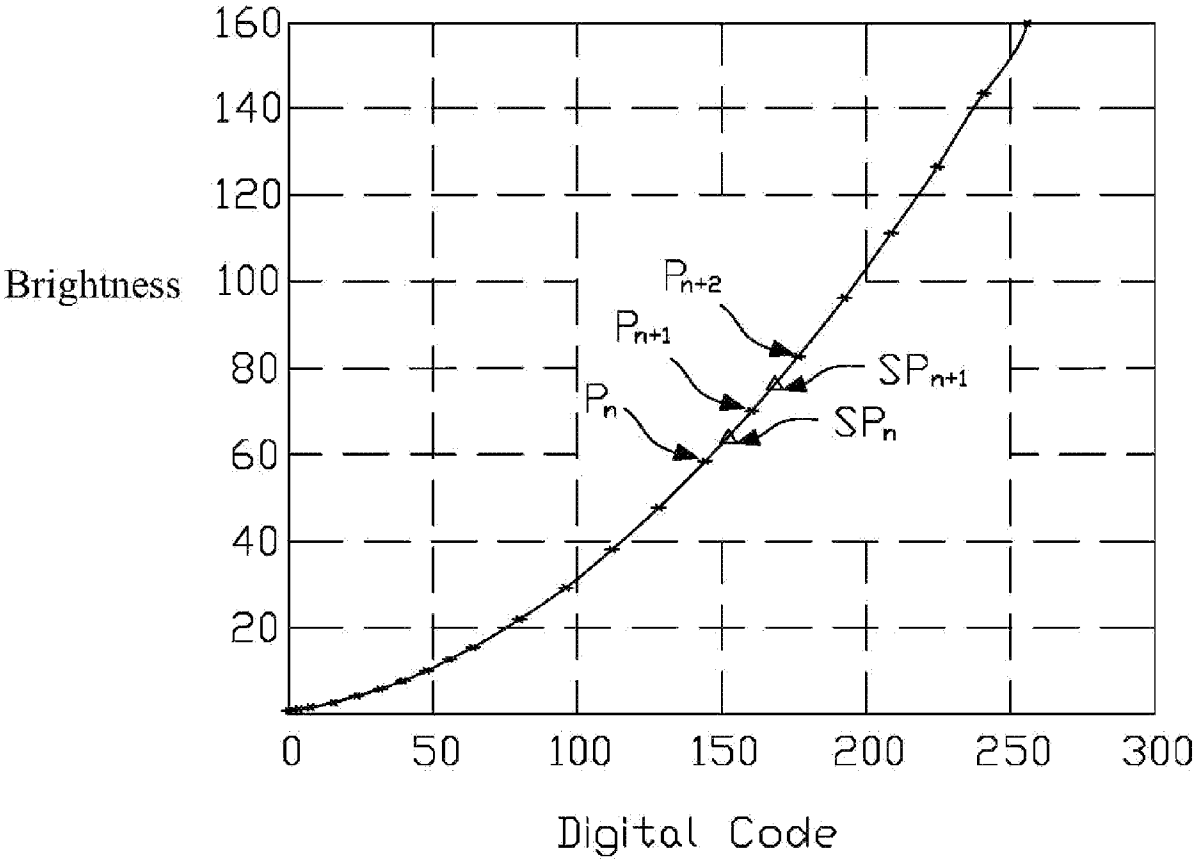
FIG. 4 shows a schematic diagram illustrating a curve of gray-level digital code versus brightness and a corresponding position of the gray level and brightness of the gray level pattern selected by one embodiment of the invention.

FIG. 4 shows a curve of gray-level digital code versus brightness and a corresponding position of the gray level and brightness of the gray level pattern selected by one embodiment of the invention. As shown in FIG. 4, according to the Gamma curve, relatively exquisite interpolation is needed for a low gray level in order to avoid overly corrected after interpolation. Thus, in the selected patterns of this embodiment, as described, 4 is used as an interval for a lower Pn level (0~8), 8 is used as an interval for a medium Pn level (8~64), and 16 is used as an interval for a higher Pn level (64~240).

As the brightness of the predetermined patterns comprises the brightness of a plurality of gray level patterns that use red, green, and blue to generate gray level colors, the Step S04 in FIG. 3 can comprise the following steps (a) and (b).

Step (a): calculating the brightness components of red (R), green (G), and blue (B) colors of the 22 gray level patterns, based on the brightness of the 22 gray level patterns. The following describes the detail method on how to calculate the brightness components.

At first, according to the principle of CIE 1931 tristimulus values, the tristimulus values of a gray level is equal to the sum of tristimulus values of R/G/B components, as shown in the following equation (1):

$$X_{Gray}=X_R X_G X_B,$$

$$Y_{Gray}=Y_R Y_G Y_B,$$

$$Z_{Gray}=Z_R Z_G Z_B, \tag{1}$$

Next, if the gray level ($X_{gray}$, $Y_{gray}$, $Z_{gray}$) corresponds to red color coordinates ($x_r$, $y_r$), green color coordinates ($x_g$, $y_g$), and blue color coordinates ($x_b$, $y_b$), $Z_R$ may be represented by $X_R$ and $Y_R$; $Z_G$ may be represented by $X_G$ and $Y_G$; and $Z_B$ may be represented by $X_B$ and $Y_B$ and thus equation (2) is obtained.

$$x:y:(1-x-y)=X:Y:Z, \tag{2}$$

Therefore, $Y_R$, $Y_G$, and $Y_B$ of any level can be acquired according to the equations (3) and (4) and $X_{Gray}$, $Y_{Gray}$, and $Z_{Gray}$. As shown in the following, the equation (3) is as following equation.

$$[X_{Gray}\ \ Y_{Gray}\ \ Z_{Gray}] = [Y_R\ \ Y_G\ \ Y_B] \times \begin{bmatrix} \frac{x_r}{y_r} & 1 & \frac{1-x_r-y_r}{y_r} \\ \frac{x_g}{y_g} & 1 & \frac{1-x_g-y_g}{y_g} \\ \frac{x_b}{y_b} & 1 & \frac{1-x_b-y_b}{y_b} \end{bmatrix} \tag{3}$$

In addition, the equation (4) is as following equation.

$$[Y_R\ \ Y_G\ \ Y_B] = [X_{Gray}\ \ Y_{Gray}\ \ Z_{Gray}] \times M_{GraytoRGB}, \tag{4}$$

where $$M_{GraytoRGB} = \begin{bmatrix} \frac{x_r}{y_r} & 1 & \frac{1-x_r-y_r}{y_r} \\ \frac{x_g}{y_g} & 1 & \frac{1-x_g-y_g}{y_g} \\ \frac{x_b}{y_b} & 1 & \frac{1-x_b-y_b}{y_b} \end{bmatrix}^{-1},$$

The chroma display characteristic matrix $M_{GraytoRGB}$ is acquired based on the chromas of the full-red, full-green, and full-blue of predetermined patterns for the display and each level uses this chroma display characteristic matrix $M_{GraytoRGB}$. Then, the brightness components of red (R), green (G), and blue (B) of each gray level pattern is calculated based on the brightness and chroma of each gray level pattern.

Furthermore, the brightness of light leakage at the zero level (black) is used to correct the brightness components of red (R), green (G), and blue (B) of each gray level pattern again. Since the display panel 114 has the dark-state light leakage problem, that is, light leaks from channels of R/G/B colors of the display panel 114 while the channels of R/G/B colors are all closed. If the equation (4) is used to estimate the brightness components of red (R), green (G), and blue (B), errors occur. In the estimation algorithm according to one embodiment of the invention, the following correcting equation:

$$[K_R K_G K_B]=[X_K Y_K Z_K]\times M_{GraytoRGB}, \tag{5}$$

is added where $K_R$, $K_G$, and $K_B$ represent light leakage while the channels of R/G/B colors are all closed, that is, the brightness of light leakage at the zero level (black). After correction, the values of the R/G/B components $Y'_R$, $Y'_G$, and $Y'_B$, of each level are as follows:

$$Y'_R=Y_R+K_B+K_G,$$

$$Y'_G=Y_G+K_R+K_B,$$

$$Y'_B=Y_B+K_R+K_G,$$

$$Y'_{KR}=Y'_{KG}=Y'_{KB}=Y_K, \tag{6}$$

where $Y_K/Y'_{KR}/Y'_{KG}/Y'_{KB}$ separately represent the brightness of gray, red, green, blue colors at the zero level.

Step (b): calculating the brightness components of 256 gray levels of three colors (R/G/B) by separately using the nonlinear interpolation algorithm, based on the brightness components of red (R), green (G), and blue (B) colors of the 22 gray level patterns. Referring to FIG. 4, the following uses one color as an example to illustrate how to calculate the brightness components of each level for this color.

According to the brightness components of one color in the above 22 gray level patterns, the brightness component difference rate (hereinafter representing by Lv_Slope) of two adjacent levels (22 levels) of this color can be calculated and thus the brightness component difference rates of the 21 levels (median point of two adjacent levels among 22 levels, that is, intermediate value of two adjacent levels) are acquired. Therefore, these 21 levels are defined as SPn where n=0~20. SPns are 2, 6, 12, 20, 28, 36, 44, 52, 60, 72, 88, 104, 120, 136, 152, 168, 184, 200, 216, 232, 248 where the median of 240 and 255 is accurately 247.5 but rounded up to an integer 248 since human eyes are less sensitive to a brighter frame. However, the above example is not used to limit the scope of the invention but only an example. The brightness component difference rates of the 21 levels SPn are also calculated. The brightness component difference rates of the 21 levels SPn are acquired through dividing the difference of the brightness components of this level and its adjacent level by the difference of the corresponding digital codes of these two levels. The relationship satisfies the following equation (7):

$$Lv_Slope[SP_n]=(Lv[P_{n+1}]-Lv[P_n])/(Code[P_{n+1}]-Code[P_n]),$$

$$Code[SP_n]=round((P_{n+1}+P_n)/2),\ n=0\sim20, \tag{7}$$

where $Lv[P_n]$ represents the brightness component (Lv) of the $n^{th}$ level; $Code[P_n]$ and $Code[SP_n]$ separately represent digital codes of Pn and SPn; Lv_Slope[SPn] represents the brightness component difference rate of the $n^{th}$ level; and round( ) function represents a round-off function.

In this embodiment, the nonlinear interpolation algorithm comprises the one that makes the slope of two adjacent brightness components of red, green, and blue colors of the gray level patterns vary linearly. Specifically, assuming the slope among 21 levels varies linearly, that is, the slope difference rate is an equal difference rate, the distribution of brightness component difference rates of 256 levels can be calculated via interpolation and extrapolation. Lv_Slope[Digital_Code] where Digital_Code=0~255 is shown as the following equation (8):

$$Lv_Slope[Digital_Code]=Lv_Slope[SP_n]+(SlopeRate)\times(Coide-Code[SP_n]),$$

$$SlopeRate=(Lv_Slope[SP_{n+1}]-Lv_Slope[SP_n])/(Code[SP_{n+1}]-Code[SP_n]),$$

$$\text{where } Code[SP_{n+1}]>Code>Code[SP_n]. \quad (8)$$

Moreover, accompanying with the brightness components of each level of the original 22 levels, the brightness components of each level of 256 levels can be calculated, as shown in the following equation (9).

$$P_n<Digital_Code<P_{n+1};$$

$$Lv[Digital_Code]=Lv[P_n]+Lv_Slope[P_n],\ Digital_Code=Code[P_n]+1;$$

$$Lv[Digital_Code]=Lv[Digital_Code-1]+Lv_Slope[Digital_Code-1],$$

$$Digital_Code>(Code[P_n]+1); \quad (9)$$

In this embodiment, m display characteristics of the Step S06 can be 256 levels of brightness. The brightness Lv(Digital_Code) of each levels, the maximum characteristic value ($Lv_{max}$) and a reference Gamma satisfy the following equation (10) and are used to correct 256 levels of brightness of these three colors.

$$Lv(Digital_Code) = Lv_{max}\times\left(\frac{Digital_Code}{255}\right)^{Gamma}, \quad (10)$$

Since there is a physical limit for the display panel 114 at the darkest state, in the reference Gamma curve calculated from the equation (10), the brightness Lv values at lower levels are all far smaller than the darkest value generated by the display panel 114. Thus, it results in unusual parameters of Gamma LUT calculated at lower levels so that the lower level portions of gray levels after correction become completely black or results in color shift due to excessive difference among R/G/B Gamma Look-Up tables. Therefore, in one embodiment, the equation (11) is used in correction:

$$Lv(Digital_Code) = Lv_{max}\times\left(\frac{Digital_Code}{255}\right)^{Gamma} + Lv_Black, \quad (11)$$

where Lv_black represents the brightness value of the display panel 114 at the darkest state.

According to another embodiment of the invention, the method for creating a Gamma Look-Up table comprises the Step S06 and can comprise a step S62.

Step S62: further correcting the m display characteristics of the x colors based on a reference color temperature value (D) so that the Gamma Look-Up table is created. Color temperature control correction on the m display characteristics of the x colors will be described in the following.

At first, the reference color temperature value can be tristimulus values of a reference color temperature measured by the color analysis device 121. From the tristimulus values of the reference color temperature, in this embodiment, D65 ($X_{D65}$, $Y_{D65}$, $Z_{D65}$) is used as an example. From the equation (4), the values of the corresponding R/G/B components $Y_{R_D65}$, $Y_{G_D65}$, $Y_{B_D65}$ can be calculated. Then, the ratios of the R/G/B components $Y_{R_D65}$, $Y_{G_D65}$, $Y_{B_D6}$ to the R/G/B components $Y_{R_white}$, $Y_{G_white}$, $Y_{B_white}$ at the brightest point and the equation (12) are used to acquire $R_{ratio}$, $G_{ratio}$, $B_{ratio}$, as shown in the following:

$$R_{ratio}=C_{ratio}\times Y_{R_D65}/Y_{R_White}$$

$$G_{ratio}=C_{ratio}\times Y_{G_{D65}}/Y_{G_White}$$

$$B_{ratio}=C_{ratio}\times Y_{B_D65}/Y_{B_White}$$

$$C_{ratio}=1/\max(Y_{R_D65}/Y_{R_White}, Y_{G_D65}/Y_{G_G_White}, Y_{B_D65}/Y_{B_White}), \quad (12)$$

where max( ) is a function for taking a maximum value.

In one embodiment, the scaler 113 can be used to directly calculate each parameter in the Gamma look-up table by the following equation.

$$Lv(Digital_Code) = R_{ratio}(\text{or } G_{ratio} \text{ or } B_{ratio})\times Lv_{max}\times\left(\frac{Digital_Code}{255}\right)^{Gamma} + Lv_Black, \quad (13)$$

where Lv_black represents the brightness value of the display panel 114 at the darkest state.

Figure 5:
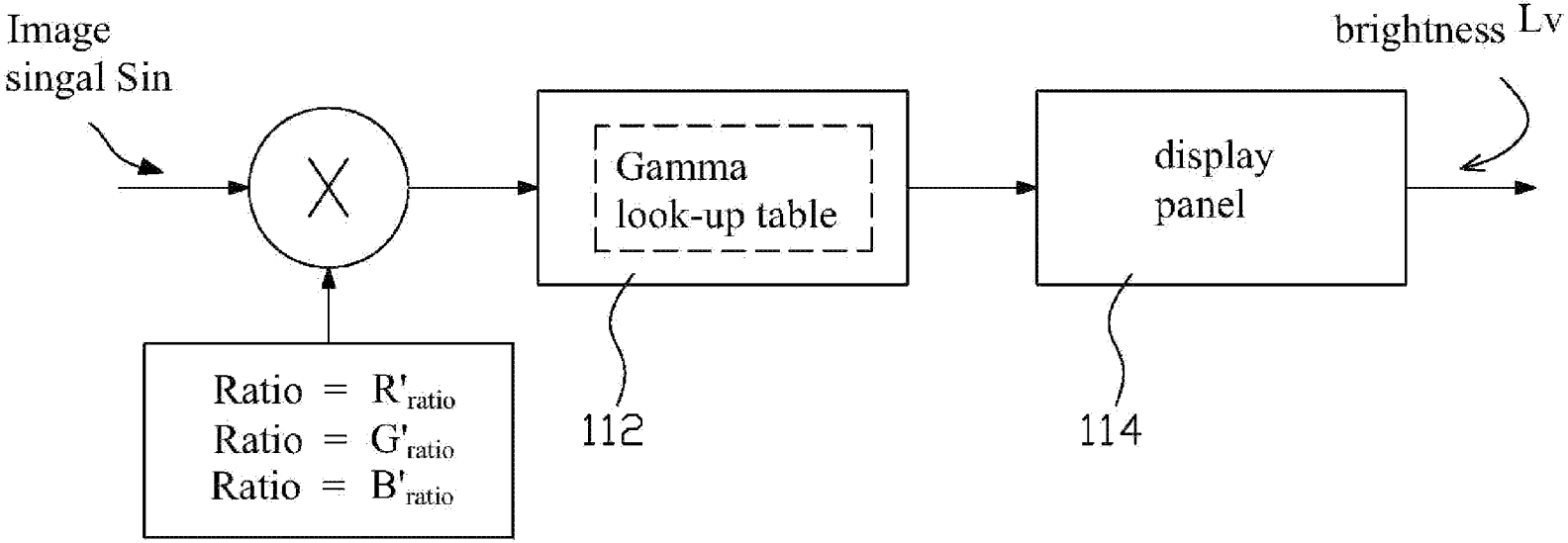
FIG. 5 shows a functional block diagram illustrating performing color temperature control correction on display characteristics via hardware.

FIG. 5 shows a functional block diagram illustrating performing color temperature control correction on display characteristics via hardware. Referring to FIG. 5, in another embodiment, hardware can be used to implement the color temperature control correction on display characteristics. As the Gamma look-up table is acquired by performing gamma correction (for example, gamma is 2.2) without performing color temperature control correction for the display panel 114, $R'_{ratio}$, $G'_{ratio}$, $B'_{ratio}$ can be calculated from the calculated $R_{ratio}$, $G_{ratio}$, $B_{ratio}$ according to the equation (14). Then, the design shown in FIG. 4 is used to implement the color temperature control correction where gamma is left unchanged.

$$R'_{ratio}=R_{ratio}^{1/gamma};$$

$$G'_{ratio}=G_{ratio}^{1/gamma};$$

$$B'_{ratio}=B_{ratio}^{1/gamma}; \quad (14)$$

In conclusion, the display device 100 according to one embodiment of the invention provides at least three ways to update the Gamma look-up table created by the method for creating a Gamma look-up table according to one embodiment of the invention. Therefore, for the display device 100 according to one embodiment of the invention, the display system makers can have the Gamma look-up table be updated instantaneously and forever updated without recompiling firmware (F/W) and then having such firmware burned in the display device. The above three ways are described in the following.

(a) After the server 131 calculates and acquires a plurality of gamma corrected parameters, a Gamma look-up table is created. The Gamma look-up table is stored in the memory 112 of the display device 100. Then, the server 131 issues a predetermined command or lets the display device 100 restart to trigger the corresponding firmware for reading the Gamma look-up table from the memory 112 and writing to the register of the scaler 113 to be used by the scaler 113.

(b) The server 131 stores the data of display characteristics (for example, 22×3 brightness characteristics and 21×3 brightness difference characteristics) of the display panel 114 in the memory 112 of the display device 100. Then, the server 131 issues a predetermined command or lets the display device 100 restart to trigger the corresponding firmware (F/W) for reading the data of display characteristics of the display panel 114 and calculating the gamma correction parameters to create a Gamma look-up table and writing the Gamma look-up table to the register of the scaler 113 to be used by the scaler 113.

(c) After the server 131 receives the data of display characteristics of the display panel 114 calculated by the color analysis device 121 via the predetermined patterns, the server 131 transmits them to the corresponding firmware (F/W) in the display device 100 for gamma correction so that a plurality of gamma correction parameters are generated and then stored in the memory 112. As the server 131 issues a predetermined command or lets the display device 100 restart to trigger the corresponding firmware (F/W), the server 131 accesses the gamma correction parameters from the memory 112 to create a Gamma look-up table and finally writes the Gamma look-up table into the register of the scaler 113 to be used by the scaler 113.

In addition, the method for creating a Gamma look-up table and the display device 100 according to one embodiment of the invention have at least one of the following advantages.

(1) In one embodiment, as the brightness of gray colors are converted to the R/G/B brightness components, the R/G/B brightness components are corrected based on the light leakage of the display panel so that the accuracy of the R/G/B brightness components can be increased.

(2) In one embodiment, when the correction is performed based on the reference gamma value (for example, gamma is 2.2) requested by a user, the darkest value of the display panel 11 may also be used to correct the reference Gamma curve calculated from the ideal equation so that the color shift at lower levels can be improved.

(3) In one embodiment, color temperature control correction may be performed. When the gamma correction is performed, not only the correction is performed based on the reference gamma value (for example, gamma is 2.2) requested by a user but also a reference color temperature value is selected to perform color temperature control correction. The color temperatures of all the gray levels are corrected to be a reference color temperature (for example, 5000K or 9000K).

Although the present invention has been fully described by way of examples with reference to the accompanying drawings, it should not be construed as any limitation on the implementation range of the invention. Various equivalent changes and modifications can be performed by those who are skilled in the art without deviating from the scope of the invention. The scope of the present invention is to be encompassed by the claims of the present invention. Any embodiment or claim of the present invention does not need to achieve all the disclosed objects, advantages, and characteristics described by the invention. Besides, the abstract and the title are only used to assist the search of the patent documentation and should not be construed as any limitation on the range of implementation of the invention.

What is claimed is:

1. A method for creating a Gamma look-up table (LUT), comprising:

receiving display characteristics of a plurality of predetermined patterns;

calculating interpolated display characteristics of a plurality of colors by using a nonlinear interpolation algorithm based on the display characteristics of the predetermined patterns wherein the number of the display characteristics of the predetermined patterns is smaller than the product of the number of the colors and the number of the interpolated display characteristics of the colors; and correcting the interpolated display characteristics of the colors on the basis of a maximum display characteristic value and a reference gamma value so that the Gamma look-up table is created;

wherein the predetermined patterns comprise a plurality of gray level patterns which one-by-one correspond to a plurality of levels, and the interval of a pair of adjacent gray level patterns among the gray level patterns is different from the interval of another pair of adjacent gray level patterns among the gray level patterns, wherein the colors comprise a red, a green, and a blue colors and the display characteristics of the predetermined patterns comprise the chroma of the predetermined patterns of the red color, the chroma of the predetermined patterns of the green color, the chroma of the predetermined patterns of the blue color, and the brightness of the gray level patterns, and wherein calculating the interpolated display characteristics comprises:

separately calculating the brightness components of red, green, and blue colors of the gray level patterns based on the brightness of the gray level patterns and the chromas of the predetermined patterns of the red, green, and blue colors; and calculating the brightness components of the interpolated display characteristics of the red, green, and blue colors by separately using the nonlinear interpolation algorithm based on the brightness components of red, green, and blue colors of the gray level patterns.

2. The method according to claim 1, wherein the step of creating the Gamma look-up table further comprises:

correcting the interpolated display characteristics of the colors on the basis of a reference color temperature value to create the Gamma look-up table.

3. The method according to claim 1, wherein the step of calculating the brightness components of red, green, and blue colors of the gray level patterns comprises:

calculating a chroma display characteristic matrix based on the chromas of the predetermined patterns of the red, green, and blue colors and then separately calculating the brightness components of red, green, and blue colors of the gray level patterns based on the chroma display characteristic matrix and the brightness of the gray level patterns.

4. The method according to claim 3, wherein separately calculating the brightness components of red, green, and blue colors of the gray level patterns based on the chroma display characteristic matrix and the brightness of the gray level patterns comprises multiplying the brightness of the gray level patterns by the chroma display characteristic matrix.

5. The method according to claim 1, wherein the step of calculating the brightness components of red, green, and blue colors of the gray level patterns comprises:

correcting the brightness components of red, green, and blue colors of the gray level patterns based on brightness of light leakage at the zero level.

6. The method according to claim 1, wherein the nonlinear interpolation algorithm comprises an algorithm which makes the slope of two adjacent brightness components of red, green, and blue colors of the gray level patterns vary linearly.

7. The method according to claim 1, wherein the step of calculating the brightness components of red, green, and blue colors of the gray level patterns further comprises:

correcting the corresponding brightness of the red, green, and blue colors of the gray level patterns based on a reference color temperature value so that the Gamma look-up table is created.

8. The method according to claim 7, wherein the reference color temperature value is the tristimulus values of a reference color temperature.

9. The method according to claim 1, wherein the numerical values of the levels are gray level values that are integers ranging from 0 to 255 and the numerical values of the levels are different from each other.

10. The method according to claim 1, wherein the number of levels of the pair of adjacent gray level patterns among the gray level patterns is smaller than the number of levels of the another pair of adjacent gray level patterns; and the interval of the pair of adjacent gray level patterns among the gray level patterns is smaller than the interval of the another pair of adjacent gray level patterns.

11. A display device, comprising:

a memory for storing a Gamma look-up table (LUT) that is created by using a nonlinear interpolation algorithm based on display characteristics of a plurality of predetermined patterns wherein the predetermined patterns comprise a plurality of gray level patterns which one-by-one correspond to a plurality of levels, and the interval of a pair of adjacent gray level patterns among the gray level patterns is different from the interval of another pair of adjacent gray level patterns among the gray level patterns, wherein the interval of each pair of adjacent gray level patterns is one of a plurality of predetermined intervals, wherein each of the predetermined intervals is used for a predetermined gray level range; and an image processing unit, for receiving an image signal, accessing the Gamma look-up table from the memory, and correcting the image signal based on the Gamma look-up table to generate a corrected image signal and transmit the corrected image signal to a display panel.

12. The device according to claim 11, wherein the Gamma look-up table is created by the following steps, comprising:

calculating interpolated display characteristics of at least one color by using a nonlinear interpolation algorithm based on the display characteristics of the predetermined patterns wherein the number of the display characteristics of the predetermined patterns is smaller than the product of the number of the at least one color and the number of the interpolated display characteristics of the at least one color; and correcting the interpolated display characteristics of the at least one color on the basis of a maximum display characteristic value and a reference gamma value so that the Gamma look-up table is created.

13. The device according to claim 12, wherein the step of calculating the interpolated display characteristics of the at least one color further comprises:

correcting the interpolated display characteristics of the at least one color on the basis of a reference color temperature value so that the Gamma look-up table is created.

14. The device according to claim 12, wherein the at least one color comprises a red, a green, and a blue colors and the display characteristics of the predetermined patterns comprise the chroma of the predetermined patterns of the red color, the chroma of the predetermined patterns of the green color, the chroma of the predetermined patterns of the blue color, and the brightness of the gray level patterns.

15. The device according to claim 12, wherein the step of calculating interpolated display characteristics of the colors comprises:

separately calculating the brightness components of red, green, and blue colors of the gray level patterns, based on the brightness of the gray level patterns and the chromas of the predetermined patterns of the red, green, and blue colors; and separately calculating the brightness components of the interpolated display characteristics of the red, green, and blue colors by using the nonlinear interpolation algorithm, based on the brightness components of the red, green, and blue colors of the gray level patterns.

16. The device according to claim 15, wherein the step of calculating the brightness components of red, green, and blue colors of the gray level patterns further comprises:

correcting the brightness components of red, green, and blue colors of the gray level patterns based on brightness of light leakage at the zero level.

17. The device according to claim 15, wherein the nonlinear interpolation algorithm comprises an algorithm which makes the slope of two adjacent brightness components of red, green, and blue colors of the gray level patterns vary linearly.

18. A display device, comprising:

a display panel;

a memory for storing display characteristics of a plurality of predetermined patterns wherein the display characteristics of the predetermined patterns correspond to the display panel, the predetermined patterns comprise a plurality of gray level patterns which one-by-one correspond to a plurality of levels, and the interval of a pair of adjacent gray level patterns among the gray level patterns is different from the interval of another pair of adjacent gray level patterns among the gray level patterns, wherein the interval of each pair of adjacent gray level patterns is one of a plurality of predetermined intervals, wherein each of the predetermined intervals is used for a predetermined gray level range; and an image processing unit, for receiving an image signal, accessing the display characteristics of the predetermined patterns from the memory, and correcting the image signal based on the display characteristics of the predetermined patterns to generate a corrected image signal and output the corrected image signal to the display panel.

19. The device according to claim 18, wherein the image processing unit is for:

calculating interpolated display characteristics of a plurality of colors by using a nonlinear interpolation algorithm based on the display characteristics of the predetermined patterns wherein the number of the display characteristics of the predetermined patterns is smaller than the product of the number of the colors and the number of the interpolated display characteristics of the colors; and correcting the interpolated display characteristics of the colors on the basis of a maximum display characteristic value and a reference gamma value to create the Gamma look-up table and then correcting the image signal based on the Gamma look-up table so that the image signal is corrected according to the display characteristics of the predetermined patterns.

20. The device according to claim 19, wherein the colors comprise a red, a green, and a blue colors and the display characteristics of the predetermined patterns comprise the chroma of the predetermined patterns of the red color, the chroma of the predetermined patterns of the green color, the chroma of the predetermined patterns of the blue color, and the brightness of the gray level patterns.

21. The device according to claim 20, wherein the image processing unit is for:

separately calculating the brightness components of red, green, and blue colors of the gray level patterns, based on the brightness and chromas of the gray level patterns and the chromas of the predetermined patterns of the red, green, and blue colors; and separately calculating the brightness components of the interpolated display characteristics of the red, green, and blue colors by using the nonlinear interpolation algorithm, based on the brightness components of red, green, and blue colors of the gray level patterns so that the interpolated display characteristics of these colors are calculated.

22. The device according to claim 21, wherein the image processing unit is for:

correcting the brightness components of red, green, and blue colors of the gray level patterns based on brightness of light leakage at the zero level so as to calculate the brightness components of red, green, and blue colors of the gray level patterns.

23. The device according to claim 21, wherein the nonlinear interpolation algorithm comprises an algorithm which makes the slope of two adjacent brightness components of red, green, and blue colors of the gray level patterns vary linearly.

* * * * *